US005173388A

United States Patent [19]

Uezono et al.

[11] Patent Number: 5,173,388

[45] Date of Patent: Dec. 22, 1992

[54] DEVELOPING PROCESS EXCELLENT IN IMAGE REPRODUCIBILITY

[75] Inventors: Tsutomu Uezono, Sagamihara; Akihiro Watanabe, Neyagawa; Mitsushi Kuroki, Kumamoto; Toshio Nishino, Nara; Shoji Tomita, Yao, all of Japan

[73] Assignee: Mita Industrial Co., Ltd., Osaka, Japan

[21] Appl. No.: 515,711

[22] Filed: Apr. 27, 1990

[30] Foreign Application Priority Data

Apr. 28, 1989 [JP] Japan ..... 1-107330
Apr. 28, 1989 [JP] Japan ..... 1-107331
May 26, 1989 [JP] Japan ..... 1-131644

[51] Int. Cl.[5] ..... G03G 13/09
[52] U.S. Cl. ..... 430/122; 355/251
[58] Field of Search ..... 430/122, 120; 355/251

[56] References Cited

U.S. PATENT DOCUMENTS 4,610,531 9/1986 Hayashi et al. ..... 430/122
4,949,127 8/1990 Matsuda et al. ..... 430/122
4,999,272 3/1991 Tanikawa et al. ..... 430/122

*Primary Examiner*—John Goodrow
*Attorney, Agent, or Firm*—Sherman and Shalloway

[57] ABSTRACT

A developing process excellent in the reproducibility of images is disclosed. In reproducing multiple fine lines, the line width can be kept uniform in the respective lines and front end chipping or rear end chipping can be prevented, and a high-density and high-quality image can be formed, by comprehensively setting developing conditions so that the relaxation time measured under dynamic conditions in an electric circuit comprising a developing sleeve, a surface of a photosensitive material and a developing layer interposed therebetween is set within a certain range; carrying out the sliding contact between the magnetic brush of the developer and the surface of the photosensitive material so that the frequency of the contact of a carrier with the photosensitive material is set within a certain range; or establishing a specific relation among the rotation number of the developing sleeve, the saturation magnetization of the magnetic carrier and the flux density of magnetic poles in the developing sleeve or further setting the contacting frequency of the carrier within a certain range.

6 Claims, 11 Drawing Sheets

FIG. 4 (ii)

FIG. 4 (iii)

DEVELOPING PROCESS EXCELLENT IN IMAGE REPRODUCIBILITY

BACKGROUND OF THE INVENTION (1) Field of the Invention

The present invention relates to a developing process excellent in the image reproducibility. More particularly, the present invention relates to a developing process in which in reproducing multiple fine lines, the width is uniform in the respective lines and so-called front end chipping or rear end chipping is prevented, and a high-quality image can be formed.

(2) Description of the Related Art

A two-component type developer comprising a magnetic carrier and a toner is widely used in commercial electrophotographic copying machines, and in the development of an electrostatically charged image, a magnetic brush of this developer is formed on a developing sleeve having magnetic poles installed therein and the magnetic brush is brought into sliding contact with a photosensitive material having the charged image thereon to form a toner image.

Many proposals have been made in connection with developing conditions adopted for this developing process. For example, Japanese Unexamined Patent Publication No. 59-172660 teaches that a high-density image an excellent gradient can be obtained by using a two-component type developer comprising a ferrite carrier and an electroscopic toner and controlling the toner concentration, the photosensitive drum/developing sleeve peripheral speed ratio and the main pole angle in the developing sleeve within certain ranges. Moreover, Japanese Unexamined Patent Publication No. 61-118767 teaches that in carrying out the development by using a two-component type developer, a uniform high-quality image can be obtained by controlling the surface potential, the D-S distance (the distance between the photosensitive drum and the developing sleeve) and the resistance value of the magnetic carrier within certain ranges.

Furthermore, Japanese Unexamined Patent Publication No. 63-208867 teaches that in the developing process using a two-component developer comprising a magnetic carrier and a toner, scattering of the image density can be prevented by adjusting the packing ratio (PD) of the developer, defined by the following formula, to 20 to 50%:

$$PD = M/(\rho \times Ds) \times 100$$

wherein M represents the amount of the developer which has passed through the portion for regulating the height of the magnetic brush on the developing sleeve, $\rho$ represents the true specific gravity (g/cm$^3$) of the developer, and Ds represents the distance between the developing sleeve and the electrostatic latent image recording material.

In each of the former two proposals, the characteristics of the developer and the developing conditions are independently defined, and the practical developing operation is not comprehensively grasped. Furthermore, the characteristics of the developer and carrier are not defined by the dynamic state of an actual machine but under static conditions. Accordingly, the process does not cope effectively with the actual developing operation in a copying machine.

It is deemed that the latter proposal is significant in that attention is paid to the packing ratio of the developer in the developing zone. However, the contact state between the magnetic brush of the developer and the surface of the photosensitive material under actual developing conditions, that is, dynamic conditions, is not defined, and the process does not cope effectively with the actual developing operation.

SUMMARY OF THE INVENTION

We found that the phenomenon generated at the actual development can be grasped as a dynamic electric phenomenon generated in an electric circuit comprising a developing sleeve, a surface of a photosensitive material and a developer layer interposed therebetween, and that if developing conditions are set so that the relaxation time measured under dynamic conditions with respect to this electric circuit is within a certain range, a high-quality image can be obtained.

We also found that the contact state between a magnetic brush of a developer and a surface of a photosensitive material in the actual developing operation can easily be known by pouring collodion onto this magnetic brush to fix the magnetic brush and photographing the fixed magnetic brush by using a scanning type electron microscope, and that if the frequency (k), defined as the product of the number of carrier contact points (n, points per mm$^2$) per unit area of the surface of the photosensitive material and the developing length (L), is set within a certain range, a high-quality image can be obtained.

Furthermore, we found that if a specific relation is maintained among the rotation number of a developing sleeve, the saturation magnetization and the flux density of magnetic poles in the developing sleeve and preferably if the frequency (k), defined as the product of the number of carrier contact points (n, points per mm$^2$) per unit area of the surface of the photosensitive material, measured from a scanning type electron microscope photograph of the developer contacted with the surface of the photosensitive material at the actual developing operation, taken after the fixation with collodion, and the developing length (L), is set within a certain range, a high-quality image can be obtained.

We have now completed the present invention based on these findings after various experiments.

It is therefore a primary object of the present invention to provide a developing process in which in reproducing multiple fine lines, the width is uniform in the respective lines and front end chipping or rear end chipping is prevented, and a high-density and high-quality image can be obtained.

Another object of the present invention is to provide a developing process in which the reproducibility of Chinese characters is enhanced and even if formation of a copy from a copy is repeated, an excellent reproducibility is attained.

In accordance with one aspect of the present invention, there is provided a developing process excellent in the reproducibility of image, which comprises forming a magnetic brush of a two-componet type developer comprising a magnetic carrier and a toner on a developing sleeve and bringing the magnetic brush into sliding contact with a photosensitive material having a charged image thereon to form a toner image, wherein the relaxation time ($\tau$) of a circuit constructed by the developing sleeve, the developer and the surface of the photosensitive material is set at 8 to 40 milliseconds as measured at a frequency of 50 Hz under dynamic conditions while changing the surface of the photosensitive material to an electroconductive surface of the same size.

In accordance with another aspect of the present invention, there is provided a developing process excellent in the reproducibility of images, which comprises forming a magnetic brush of a two-component type developer comprising a magnetic carrier and a toner on a developing sleeve and bringing the magnetic brush into sliding contact with a photosensitive material having a charged image thereon to form a toner image, wherein the developing sleeve and the surface of the photosensitive material are driven in the same direction at the nip position, and the developing conditions are set so that the time difference (ΔT) defined by the following formula is 0 to 130 msec:

$$\Delta T = \frac{Nip \cdot Vs}{Vd^2} - \tau \quad (1)$$

wherein Nip represent the nip width (mm) of the developer on the surface of the photosensitive material, Vs represents the moving speed (mm/sec) of the developing sleeve, Vd represents the moving speed (mm/sec) of the surface of the photosensitive material, and $\tau$ represents the relaxation time (msec) measured at a frequency of 50 Hz under dynamic conditions while changing the surface of the photosensitive material to an electroconductive surface of the same size with respect to a circuit constructed by the developing sleeve, the developer and the surface of the photosensitive material.

In accordance with still another aspect of the present invention, there is provided a developing process excellent in the reproducibility of images, which comprises forming a magnetic brush of a two-component type developer comprising a magnetic carrier and a toner on a developing sleeve and bringing the magnetic brush into sliding contact with a photosensitive material having a charged image thereon, wherein the sliding contact between the magnetic brush and the photosensitive material is carried out so that the frequency (k) defined by the following formula is 100 to 700:

$$k = L \cdot n \quad (2)$$

wherein n represents the number of carrier contact points (points per $mm^2$) per unit area of the surface of the photosensitive material, determined from a scanning electron microscope photograph with respect to the collodion-fixed magnetic brush, and L represents the developing length defined by the following formula:

$$L = \frac{Nip}{Vd}(Vs - Vd) \quad (3)$$

in which Nip represents the nip width (mm) of the developer on the surface of the photosensitive material, Vs represents the moving speed (mm/sec) of the developing sleeve and Vd represents the moving speed (mm/sec) of the surface of the photosensitive material.

In accordance with still another aspect of the present invention, there is provided a developing process excellent in the reproducibility of images, which comprises forming a magnetic brush of a two-component type developer comprising a magnetic carrier and a toner on a developing sleeve and bringing the magnetic brush into sliding contact with a photosensitive material having a charged image thereon, wherein the developing conditions are set so that the requirement defined by the following formula is satisfied:

$$15{,}000 \geqq \frac{m \cdot H}{f} \geqq 7{,}000 \quad (4)$$

wherein f represents the rotation number (per second) of the developing sleeve, m represents the saturation magnetization (emu/g) of the magnetic carrier, and H represents the flux density (gauss) of magnetic poles in the developing sleeve.

Still further, in accordance with the present invention, there is provided a developing process excellent in the reproducibility of images, wherein the requirement defined by the above-mentioned formula (4) is satisfied and the frequency (k) defined by the above-mentioned formula (2) is set at 100 to 700.

BRIEF DESCRIPTION OF THE DRAWINGS

FIG. 4*i*–4(*iii*) is a diagram illustrating the relation between the distance in the feed direction and the density of the image of massed fine lines.

DETAILED DESCRIPTION OF THE PREFERRED EMBODIMENTS

Figure 8:
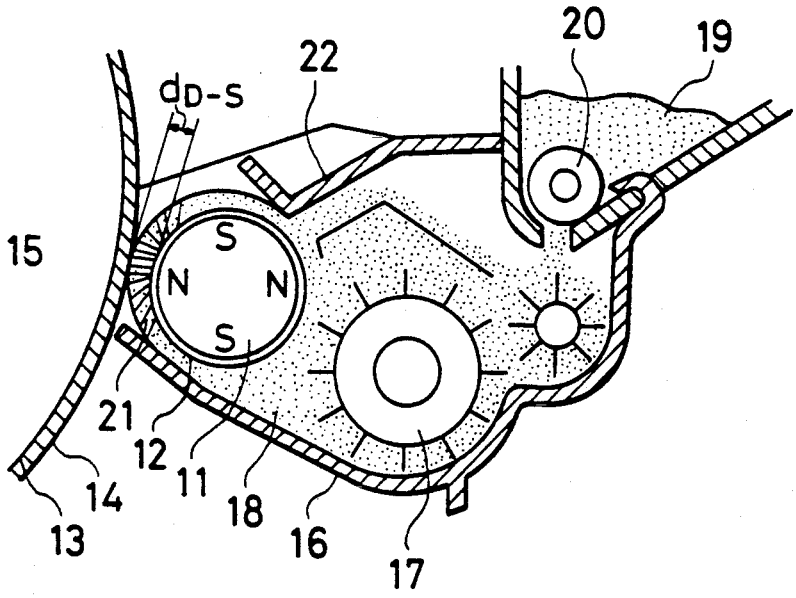
FIG. 8 is a diagram illustrating the magnetic brush developing process.

Referring to FIG. 8 illustrating the magnetic brush developing process adopted in the present invention, a magnet roll 11 having many magnetic poles N and S is contained in a developing sleeve 12 formed of a non-magnetic material such as aluminum, and a photosensitive drum 15 comprising a substrate 13 and an electrophotographic photosensitive layer 14 formed thereon is a arranged with a minute clearance of distance $d_{D\text{-}S}$ from the developing sleeve 12. The developing sleeve 12 and photosensitive drum 15 are rotatably supported on a machine frame (not shown), and they are driven so that they move in the same direction (indicated by arrows) at the nip position (the rotation directions are reverse to each other). The developing sleeve 12 is located at an opening of a developing device 16, and a mixing stirrer 17 for a two-component type developer 18 (that is, a mixture of a toner and a magnetic carrier) is arranged within the developing device 16, and a toner supply mechanism 20 for supplying a toner 19 is arranged above the mixing stirrer 17. The two-component type developer 18 is mixed by the stirrer 17 to generate a triboeletric charge on the toner, and then, the toner supplied to the developing sleeve 12 to form a magnetic brush 21 on the surface of the developing sleeve 12. The length of the magnetic brush 21 is adjusted by a brush-cutting mechanism 22, and the magnetic brush 21 is delivered to the nip position to the electrophotographic photosensitive layer 14 to develop the electrostatic latent image on the photosensitive layer 14 with the toner 19 to form a visible image 35.

According to the first embodiment of the present invention, the relaxation time ($\tau$) of the electric circuit comprising the developing sleeve 12, the two-component type developer 18 and the photosensitive layer 14, as measured at a frequency of 50 Hz under dynamic conditions while changing the surface of the photosensitive layer 14 to an electroconductive surface of the same size, is set at 8 to 40 milliseconds.

The relaxation time ($\tau$) is determined by using the apparatus shown in FIG. 1 according to the principle described below.

Figure 1:
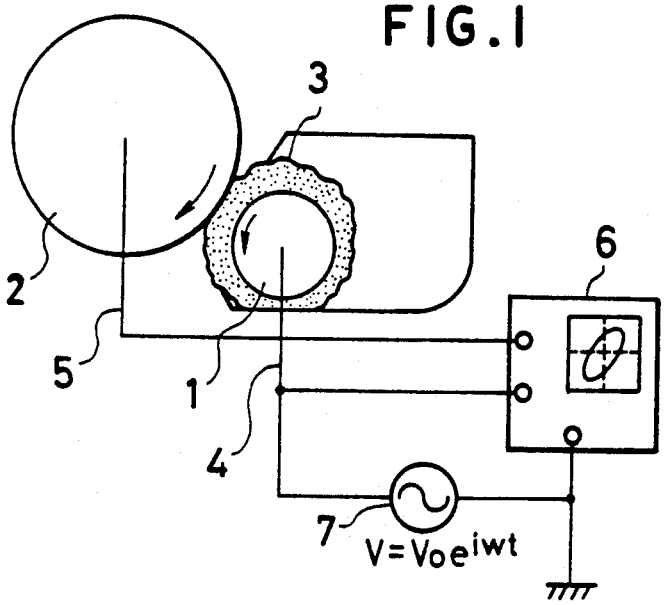
FIG. 1 is a diagram illustrating the apparatus for use in measuring the relaxation time.

Referring to FIG. 1 illustrating the apparatus for measuring the relaxation time, a two-component type developer layer 3 comprising a magnetic carrier and a toner is interposed between a developing sleeve 1 having magnetic poles (not shown) installed therein and a conductor drum 2 having the same size as that of the photosensitive drum. The drum 2 and developing sleeve 1 are driven in the same direction at the nip position (the rotation directions are reverse to each other). The sleeve 1 and drum 2 are connected to a measuring oscillograph 6 through connecting lines 4 and 5, respectively. The sleeve 1 is further connected to a measuring alternating current power source 7. The sleeve 1 and drum 2 are rotated and an alternating current voltage of 50 Hz is applied between them. The voltage and current are measured by the oscilograph 6 and the relaxation time ($\tau$) is determined from the phase difference between them.

Figure 2:
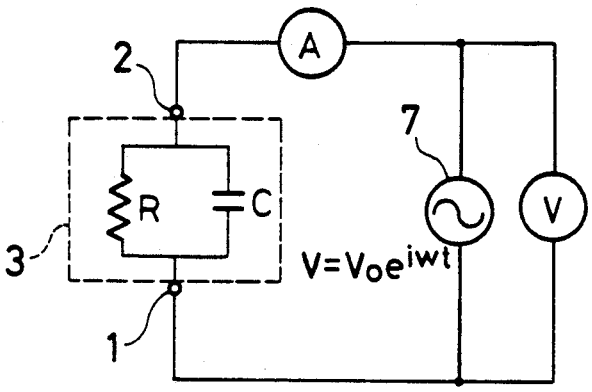
FIG. 2 is a diagram illustrating the electric circuit of FIG. 1 as an equivalent circuit.
Figure 3:
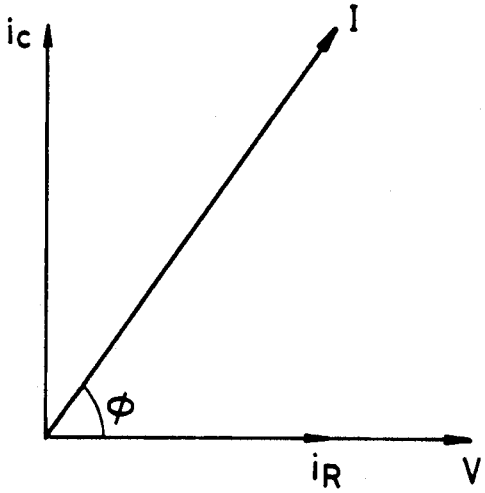
FIG. 3 is a diagram illustrating an electric current generated when an alternating current voltage is applied to the electric of FIG. 2.

The electric circuit of FIG. 1 is expressed as an equivalent circuit shown in FIG. 2. The two-component type developer layer 3 is interposed between the sleeve 1 and drum 2 at the nip position, but this developer layer 3 can be regarded as being substantially equal to a certain capacitor C and a certain electric resistance R connected in parallel. When an alternating current voltage V is applied to this circuit, a current I as shown in FIG. 3 is generated. Namely, the current $i_R$ flowing in the resistance R is of the same phase as that of the voltage V, but the current $i_C$ flowing in the capacitor C is of the phase advanced by 90° over that of the voltage V. Accordingly, the phase of the entire current I is advanced by $\phi$ over that of the voltage. Accordingly, supposing that the phase difference between the voltage and current is $\phi$ and the angular frequency of the measuring power source is w ($=2\pi f$, f: frequency), the relaxation time ($\tau$) in this circuit is determined according to the following formula:

$$\tau = \frac{\tan\phi}{\omega} \tag{5}$$

The present invention is based on the finding that if the developing conditions are comprehensively set so that the relaxation time ($\tau$) thus determined under dynamic conditions is 8 to 40 milliseconds, especially 10 to 30 milliseconds, in developing massed fine lines, a uniform line width is maintained in the respective fine lines and front end chipping or rear end chipping can be prevented, and a copied image having a high quality can be obtained.

Figure 4:
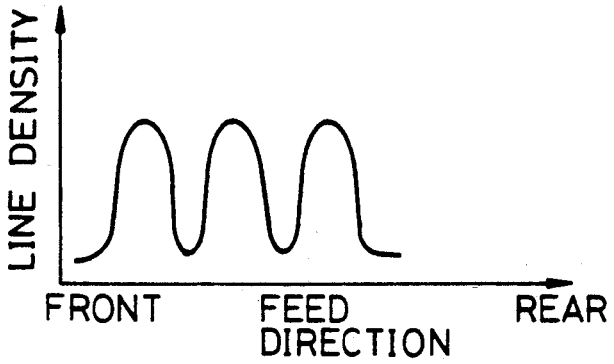
Figure 4:
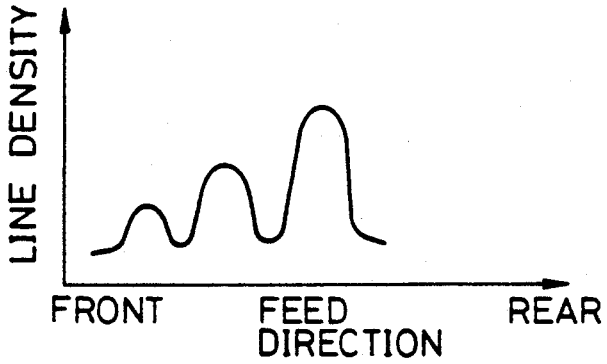
Figure 4:
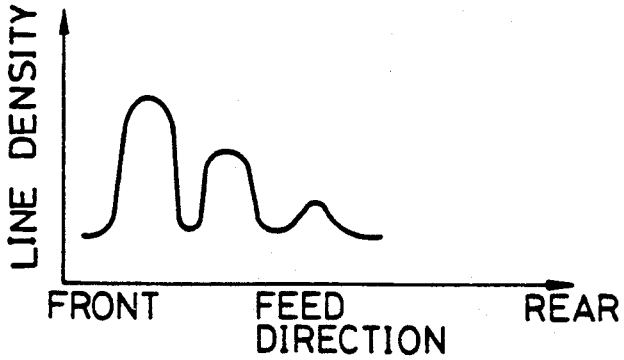

Referring to FIG. 4 illustrating occurrence of top end chipping or rear end chipping in developing massed fine lines, the distance in the feed direction is plotted on the abscissa and the density of the reflected image of the copied image of massed fine lines by a microdensitometer is plotted on the ordinate, whereby the relation between them is plotted. In FIG. 4, curve (i) shows the case where the line width is uniform in the respective fine lines and front end chipping or rear end chipping is not observed, curve (ii) shows the case where front end chipping is conspicuous, and curve (iii) shows the case where rear end chipping is conspicuous. Supposing that the image densities at respective peak in the feed direction are A, B, and C, the deviation ($\delta$) in the feed direction is given by the following formula:

$$\delta = \frac{B + C}{A + B} \times 100 \tag{6}$$

If the value of $\delta$ is 100 or about 100, the line width is uniform in the respective lines and there is no deviation, and if the value of $\delta$ is larger than 100 or smaller than 100, front end chipping or rear end chipping is caused.

Figure 5:
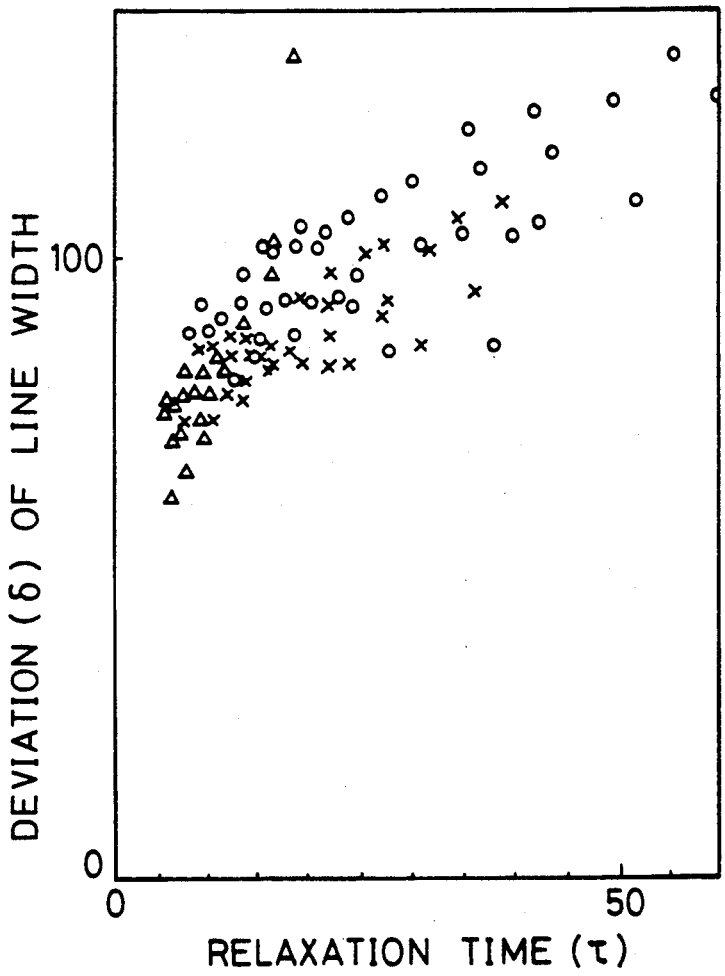
FIG. 5 is diagram illustrating the relation between the relaxation time ($\tau$) and the deviation ($\delta$) of the line width.

FIG. 5 illustrates the relation between the relaxation time ($\tau$) and the deviation ($\delta$) of the line width, plotted while changing the relaxation time ($\tau$) by using developers differing in the characteristics and changing the developing conditions. From the results shown in FIG. 5, it is surprisingly found that if among various combinations of the developers and developing conditions, a specific combination is selected so that the relaxation time ($\tau$) is within the above-mentioned range, the deviation of the line width can be maintained at almost 100%.

The fact that in the present invention, if the relaxation time ($\tau$) of the dynamic developing circuit selected within a certain range, the deviation of the line width in the respective lines can be decreased has been clarified as a phenomenon based on results of various experiments, and this phenomenon has not been sufficiently theoretically elucidated. However, since it is generally found that as the relaxation time ($\tau$) becomes short, rear end chipping ($\delta < 100$) is often caused and as the relaxation time ($\tau$) becomes long, front end chipping ($\tau > 100$) is often caused that if the relaxation time ($\tau$) exceeds the range specified in the present invention, at the initial stage the carrier-remaining charged image tends to bond to the toner again, resulting in reduction of the density, and that if the relaxation time ($\tau$) is below the range specified in the present invention, also the charge is lost and scraping of the toner by the carrier is performed at the terminal stage, resulting in reduction of the density.

In the present invention, the developing conditions including the characteristics of the developer are comprehensively defined by the relaxation time ($\tau$) of the developing circuit. This relaxation time ($\tau$) is adjusted by changing the capacitor component (C) and resistance component (R) of the circuit. Namely, by increasing the capacitor component or the resistance component, the relaxation time ($\tau$) is prolonged and by decreasing the capacitor component or the resistance component, the relaxation time ($\tau$) is shortened.

As the factors having influences on the capacitor component (C) and resistance component (R), there can be mentioned the shape, particle size, resistance and dielectric constant of the magnetic carrier, the shape, particle size, resistance and dielectric constant of the toner, the magneticc carrier/toner mixing ratio, the distance $d_{D\text{-}S}$ between the developing sleeve and the surface of the photosensitive material, the nip width of the developer on the surface of the photosensitive material, and the packing ratio of the two-component type developer at the nip position. For example, as the distance between the developing sleeve and the surface of the photosensitive material increases, R increases and C decreases. In contrast, as this distance decreases, R decreases and C increases. As the nip width increases, R decreases and C increases, and if the nip width decreases, R increases and C decreases. Furthermore, as the packing ratio of the developer increases, R decreases and C increases, and as the packing ratio of the developer descreases, R increases and C decreases.

As the dielectric constant $\epsilon_C$ of the magnetic carrier and the dielectric constant $\epsilon_T$ of the toner increase (decrease), the capacitor component (C) of the circuit increases (decreases). Since it is generally considered that the capacitance of the circuit is the serial synthesis of both of the dielectric constants and is equal to $\epsilon_T+\epsilon_C$, the influence of the dielectric constant $_C$ of the carrier on the capacitor (C) of the circuit is larger. Furthermore, if the mixing ratio of the magnetic carrier increases or the particle size of the magnetic carrier is made finer, the capacitor component generally tends to increase.

In the present invention, in order to reduce the deviation of the line width while maintaining the image density at a high level, it is important that the developing sleeve and the surface of the photosensitive material should be driven in the same direction, and the time difference ($\Delta T$) defined by the following formula:

$$\Delta T = \frac{Nip \cdot Vs}{Vd^2} - \tau \qquad (1)$$

wherein Nip, Vs, Vd and $\tau$ are as defined above, should be 0 to 130 milliseconds, especially 40 to 100 milliseconds. In the formula (1), $(Nip \cdot Vs)/Vd^2$ of the first term is a characteristic value expressed by the dimension of time, and this corresponds to the time of the passage of one point of the electrostatic latent image through the developing nip. On the other hand, the relaxation time ($\tau$) is considered to be time of disappearance of the carrier charge. Therefore, it is construed that the time difference ($\Delta T$) shows the matching between the above-mentioned two times.

Figure 6:
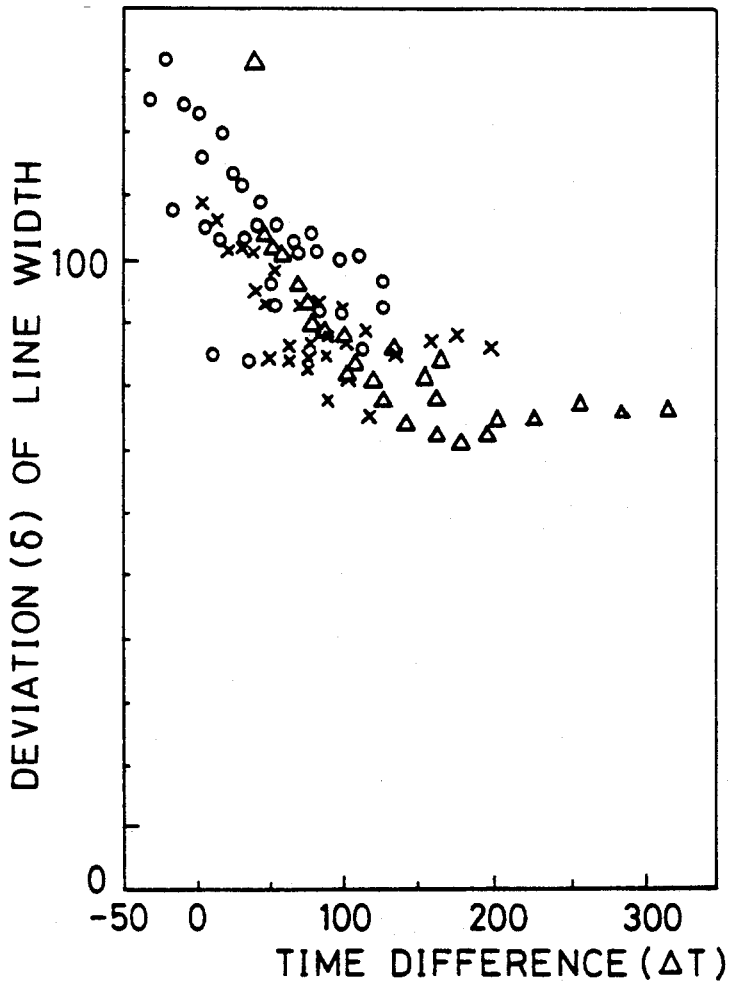
FIG. 6 is a diagram illustrating the relation between the time difference (ΔT) and the deviation ($\delta$) of the line width.
Figure 7:
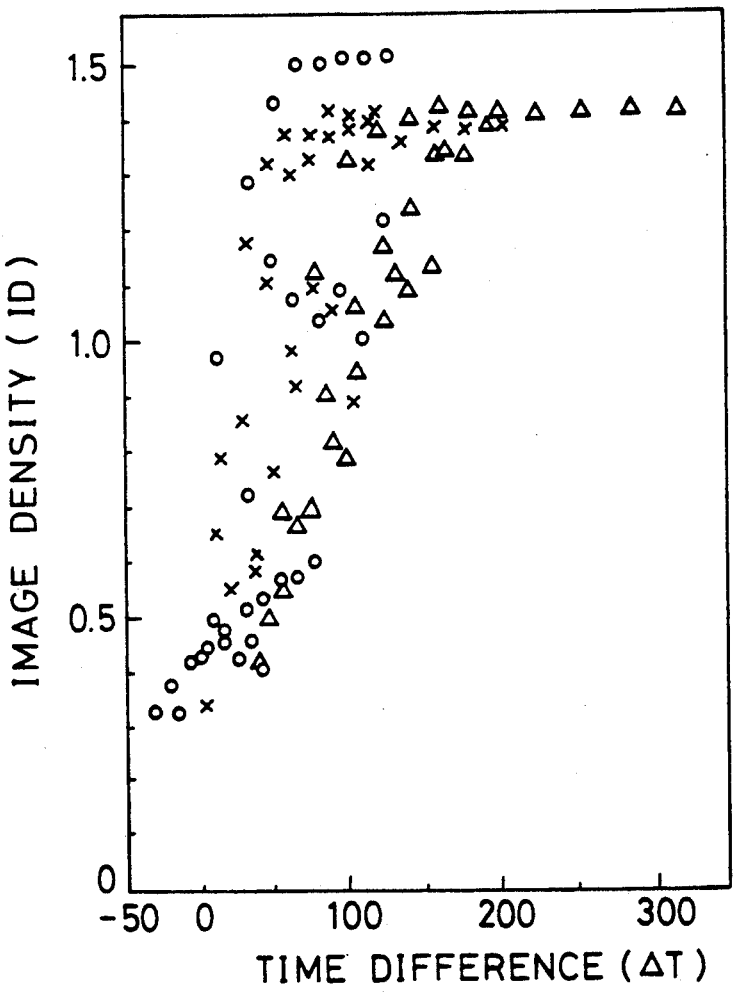
FIG. 7 is a diagram illustrating the relation between the time difference (ΔT) and the image density (ID).

FIG. 6 of the accompanying drawings illustrates the relation between the time difference ($\Delta T$) shows the deviation ($\delta$) of the line width, in which the time difference ($\Delta T$) is plotted on the abscissa and the deviation ($\delta$) of the line width is plotted on the ordinate. FIG. 7 illustrates the relation between the time difference ($\Delta T$) and the image density (ID) of the formed toner image, in which the time difference ($\Delta T$) is plotted on the abscissa and the image density (ID) is plotted on the ordinate. From these Figures, it will be understood that if the time difference ($\Delta T$) is adjusted within the above-mentioned range, it is possible to reduce the deviation of the line width (to approximate to 100%) while increasing the image density.

According to the present invention, by selecting the foregoing conditions based on the above-mentioned standards and combining the selected conditions, the relaxation time ($\tau$) can be adjusted within the above-mentioned range and the time difference ($\Delta T$) in the above-mentioned formula (1) can be adjusted within the range of from 0 to 130.

The respective conditions will now be described in detail.

Toner

The toner used in the present invention is formed by incorporating a colorant and a charge-controlling agent, optionally together with known toner additives, into a binder resin medium. Preferably, the toner used in the present invention has a resistivity of $1\times10^8$ to $3\times10^9$ $\Omega$-cm, especially $2\times10^8$ to $8\times10^8$ $\Omega$-cm, as determined according to the method described hereinafter, and it is preferred that the dielectric constant of the toner be 2.5 to 4.5, especially 3.0 to 4.0.

The binder resin medium for a toner, the colorant and other toner additives are selected and combined so that the above-mentioned characteristics can be obtained.

A styrene resin, an acrylic resin and a styrene/acrylic copolymer resin are generally used as the binder resin medium. As the styrene monomer used for the binder resin, there can be mentioned monomers represented by the following formula:

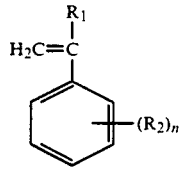

(7)

wherein $R_1$ represents a hydrogen atom, a lower alkyl group (having up to 4 carbon atoms), or a halogen atom, $R_2$ represents a substituent such as a lower alkyl group or a halogen atom, and n is an integer of up to 2, including zero, such as styrene, vinyltoluene, $\alpha$-methylstyrene, $\alpha$-chlorostyrene and vinylxylene, and vinylnaphthalene. Among them, styrene is preferably used.

As the acrylic monomer, there can be mentioned monomers represented by the following formula:

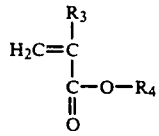

(8)

wherein $R_3$ represents a hydrogen atom or a lower alkyl group, and $R_4$ represents a hydrogen atom or an alkyl group having up to 18 carbon atoms, such as ethyl acrylate, methyl methacrylate, butyl acrylate, butyl methacrylate, 2-ethylhexyl acrylate, 2-ethylhexyl methacrylate, acrylic acid and methacrylic acid. Furthermore, other ethylenically unsaturated carboxylic acids and anhydrides thereof such as maleic anhydride, fumaric acid, maleic acid, crotonic acid and itaconic acid can be used as the acrylic monomer.

The styrene/acrylic copolymer resin is one of preferred binder resins, and the weight ratio (A)/(B) of the styrene monomer (A) to the acrylic monomer (B) is preferably in the range of from 50/50 to 90/10 and especially preferably in the range of from 60/40 to 85/15. It is generally preferred that the acid value of the resin used be from 5 to 15. Furthermore, from the viewpoint of the fixing property, it is preferred that the glass transition temperature (Tg) of the resin is from 55° to 65° C.

As the colorant to be incorporated into the resin, at least one member selected from inorganic and organic pigments and dyes, for example, carbon blacks such as furnace black and channel black, iron blacks such as triiron tetroxide, titanium oxides such as rutile titanium dioxide and anatase titanium dioxide, Phthalocyanine Blue, Phthalocyanine Green, Cadmium Yellow, Molybdenum Orange, Pyrazolone Red and Fast Violet B can be used.

As the charge-controlling agent, there can optionally be used known charge-controlling agents, for example, oil-soluble dyes such as Nigrosine Base (CI 50415), Oil Black (CI 26150) and Spiron Black, 1:1 and 1:2 metal complex dyes, metal salts of naphthenic acid, fatty acid soaps and resin acid soaps.

It is preferred that the particle size of the toner particles be 8 to 14 μm, especially 10 to 12 μm, as measured as the volume-based median diameter by Coulter Counter. The particles may be particles having an indeterminate shape, which are prepared by melt-kneading and pulverization, and spherical particles prepared by dispersion or suspension polymerization.

Magnetic Carrier

It is preferred that the dielectric constant of the magnetic carrier used in the present invention be 4 to 15, especially 5 to 9, and that the volume resistivity of the magnetic carrier be $1\times10^{10}$ to $5\times10^{11}$ Ω-cm, especially $4\times10^{10}$ to $1\times10^{11}$ Ω-cm. A ferrite carrier, especially a spherical ferrite carrier, satisfying the above conditions is preferably used as the magnetic carrier. It is preferred that the particle size of the ferrite carrier is 20 to 140 μm, especially 50 to 100 μm.

For example, sintered ferrite particles composed of at least one member selected from the group consisting of zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$) have been used as the ferrite. Especially, soft ferrites containing at least one metal component, preferably at least two metal components, selected from the group consisting of Cu, Zn, Mg, Mn and Ni, for example, copper/zinc/magnesium ferrite, have been used. In the present invention, among these ferrites, those satisfying the above-mentioned conditions are selected and used.

The magnetic characteristics, dielectric constant and electric resistance of the ferrite vary according to the chemical composition, but furthermore, these properties vary according to the particle size, particle structure, preparation process, surface coating and the like, and they depend especially on the sintering temperature and sintering time. At least one member selected from the group consisting of silicon resins, fluorine resins, acrylic resins, styrene resins, styrene/acrylic resins, olefin resins, ketone resins, phenolic resins, xylene resins and diallyl phthalate resins can be used as the coating resin for the surface coating.

Two-Component Type Developer

The mixing ratio between the toner and the magnetic carrier changes according to the physical properties of the toner and magnetic carrier, but it is preferred that the toner/carrier weight ratio be from 1/99 to 10/90, especially from 2/98 to 5/95. In order to attain the objects of the present invention, it is preferred that the resistivity of the developer as a whole be $5\times10^9$ to $5\times10^{10}$ Ω-cm, especially $1\times10^{10}$ to $4\times10^{10}$ Ω-cm.

Developing Conditions

As the developing conditions which influence on the relaxation time ($\tau$) of the developing circuit and the time difference ($\Delta T$), there can be mentioned not only the above-mentioned various properties of the developer but also various dimensional factors in the developing circuit and the moving speeds of members in the developing zone.

The change of the nip width (Nip) in the developing zone has reverse influences on the capacitor component (C) and the resistance component (R) relatively to the change of the relaxation time ($\tau$), and therefore, the nip width (Nip) has an optimum value relative to the relaxation time ($\tau$). Namely, it is generally preferred that the nip width (Nip) be 1 to 15 mm, especially 2 to 8 mm. Similarly, the distance $d_{D-S}$ between the developing sleeve and the photosensitive layer has reverse influences on C and R relative to the change of the relaxation time ($\tau$), and it is generally preferred that the distance $d_{D-S}$ be 0.5 to 3.0 mm, especially 0.7 to 1.7 mm.

In order to control formation of brush marks, it is important that the developing sleeve and the photosensitive material should be moved in the same direction at the position of sliding contact between them. Simultaneously, relatively to the nip width (Nip), it is important that the requirement defined by the above-mentioned formula (1) should be satisfied.

Furthermore, the packing ratio of the developer in the developing zone has relations to the distance $d_{D-S}$ between the developing sleeve and the photosensitive layer, the nip width (Nip), the peripheral speed (Vs) of the developing sleeve and the brush cutting length ($d_B$) on the developing sleeve.

As another developing condition, there can be mentioned a bias voltage applied between the developing sleeve and the electroconductive substrate of the photosensitive material. Preferably, this bias voltage is adjusted so that the average intensity of the electric field is 100 to 1000 V/mm, especially 125 to 500 V/mm.

Incidentally, the resistivity and dielectric constant of the toner used in the present invention are measured by using a parallel plate electrode type measuring apparatus having an electrode area of 2.72 $cm^2$ and an electrode spacing of 0.5 mm, packing the toner at a void ratio of 25% and applying an alternating current voltage having a peak amplitude of from +1 V to −1 V.

Figure 9:
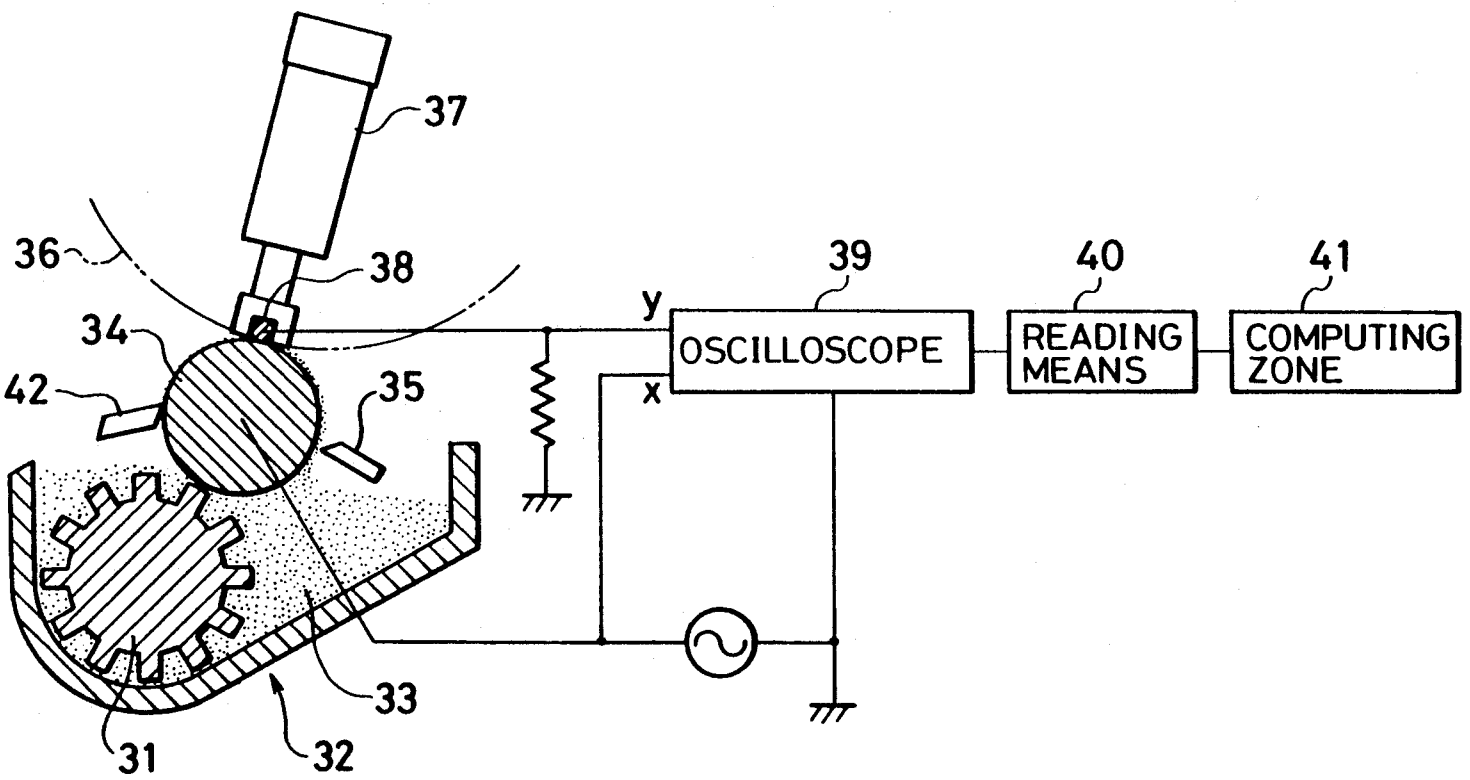
FIG. 9 is a diagram illustrating the apparatus for use in measuring the electric resistivity of the carrier in the present invention.

The resistivity of the carrier used in the present invention is measured by using a measuring apparatus shown in FIG. 9 according to the following method. More specifically, as shown in FIG. 9, a carrier 33 is introduced into a developing device 32 provided with a stirring roller 31 and the carrier 33 is supported on a sleeve 34, and the carrier 33 is delivered in the state where the thickness of the layer of the carrier 33 is adjusted to a predetermined value by a brush length-regulating member 35. Along a virtual line 36 of the surface of a photosensitive material confronting the sleeve 34 with a predetermined space therebetween, a detecting portion 38 having a predetermined surface area is arranged by a micrometer 37 as the electrode spacing-adjusting means. While the carrier 33 is being delivered together with the sleeve 34, an alternating current voltage of a predetermined frequency is applied to the sleeve 34, and a detection signal y from the detecting portion 38 is supplied to a parallel circuit of a dummy and an oscilloscope 38. Waveform data on the oscilloscope 38 are read by reading means 40 and the resistivity is calculated at a computing zone 41.

In FIG. 9, reference numeral 42 represents a cleaning blade as the cleaning means for removing the carrier 33 left on the sleeve 34.

When the dielectric constant is measured by the above-mentioned measuring apparatus, the distance between the sleeve 34 and the detecting portion 38, that is, the electrode spacing d, is adjusted to 1.2 mm, and the surface area of the detecting portion 38, that is, the electrode area S, is set at 0.785 $cm^2$. An alternating electric current having a frequency of 50 Hz is applied.

The thickness of the layer of the carrier 33 supported on the sleeve 34 is adjusted by the brush length-regulating member 35, so that the packing ratio of the carrier is about 15 to about 50%.

According to the above-mentioned embodiment of the present invention, the relaxation time of the dynamic developing circuit comprising the developing sleeve, the surface of the photosensitive material and the developer layer interposed therebetween is set within a certain range, and preferably, the difference between this relaxation time and the time of the passage of one point of the electrostatic latent image through the developing nip is without a certain range, whereby in reproducing multiple fine lines, the line width can be kept uniform, front end chipping or rear end chipping can be prevented and a high-density and high-quality image can be formed. Furthermore, a copying process excellent in the reproducibility of Chinese characters can be provided.

In accordance with another embodiment of the present invention, the sliding contact between the magnetic brush and the photosensitive material is carried out so that the frequency (k) defined by the following formula is 100 to 700:

$$K = L \cdot n \tag{2}$$

wherein n represents the number of carrier contact points (points per $mm^2$) per unit area of the surface of the photosensitive material, determined from a scanning electron microscope photograph with respect to the collodion-fixed magnetic brush, and L represents the developing length defined by the following formula:

$$L = \frac{Nip}{Vd}(Vs - Vd) \tag{3}$$

in which Nip represents the nip width (mm) of the developer on the surface of the photosensitive material, Vs represents the moving speed (mm/sec) of the developing sleeve and Vd represents the moving speed (mm/sec) of the surface of the photosensitive material.

The embodiment of the present invention is based on the finding that if the carrier contact frequency (k, contact points per mm), defined by the formula (2), is set at 100 to 700, especially 100 to 300, the line width can be kept uniform in the respective fine lines and front end chipping or rear end chipping can be prevented, and a high-quality copied image can be obtained.

Figure 10:
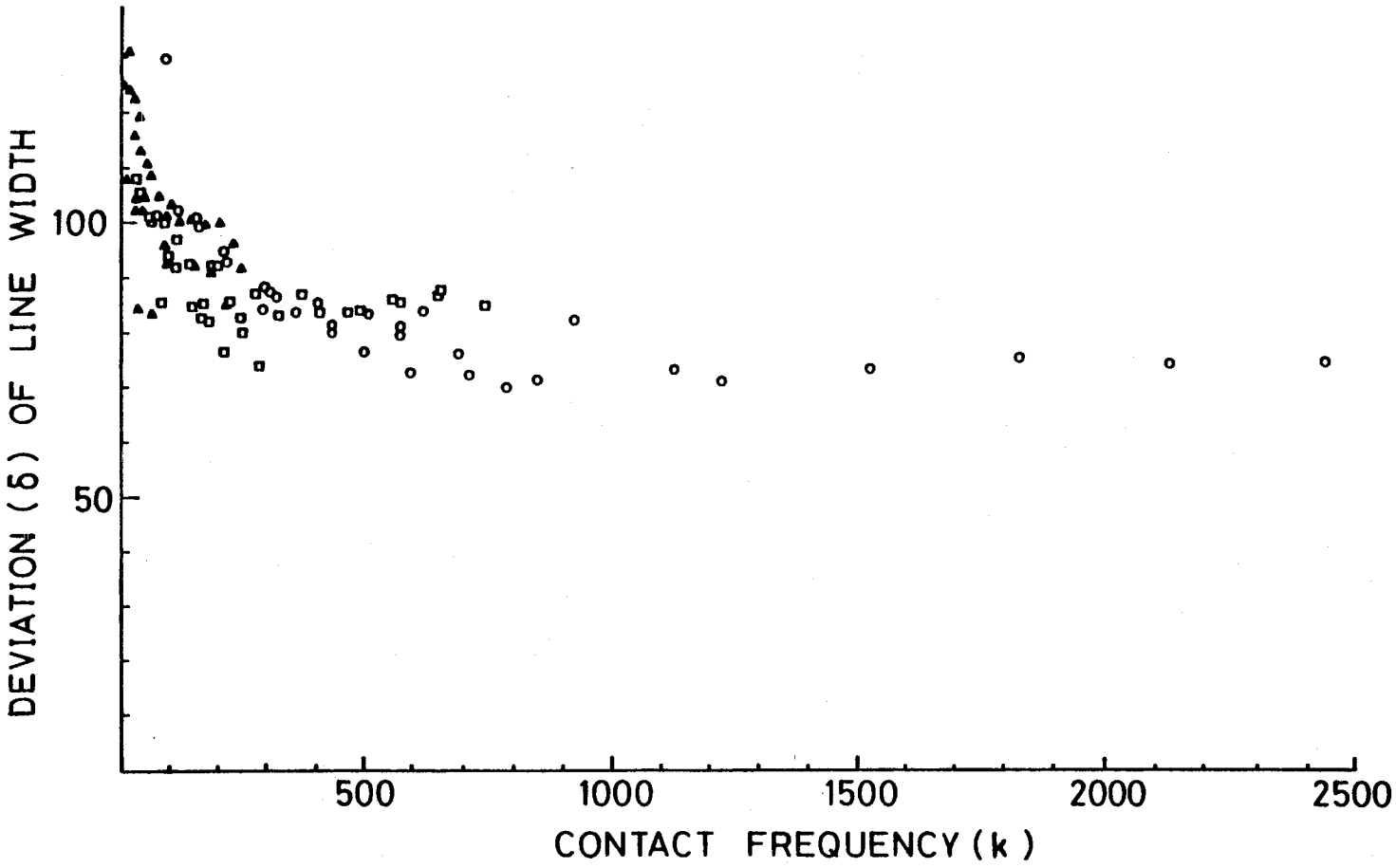
FIG. 10 is a diagram illustrating the relation between the contact frequency (k) and the deviation ($\delta$) of the line width.

FIG. 10 shows the relation between the contact frequency (k) and the deviation (δ) of the line width, observed when three developers differing in the developing characteristics are used and the contact frequency (k) of the carrier is changed by changing the developing conditions. From the results shown in FIG. 10, it is seen that if among various developing conditions and various developers, specific developing conditions and developer are selected in combination so that the contact frequency (k) is adjusted within the above-mentioned certain range, the deviation of the line width can be maintained at almost 100%. This is quite a surprising finding. Namely, in general, if the contact frequency of the carrier (developer) is reduced, front end chipping (rear end thickening) tends to appear, and in contrast, if the contact frequency is increased, rear end chipping (front end thickening) becomes conspicuous. If the contact frequency is adjusted within the above-mentioned certain range, both of the above tendencies can be effectively controlled.

The contact frequency (k) of the carrier in the present invention is expressed by the product of the number n of the contact points of the carrier per unit area of the photosensitive material and the developing length L, as represented by the above-mentioned formula (2). Accordingly, by adjusting one or both of n and L, the contact frequency can be at a desired value.

Figure 11:
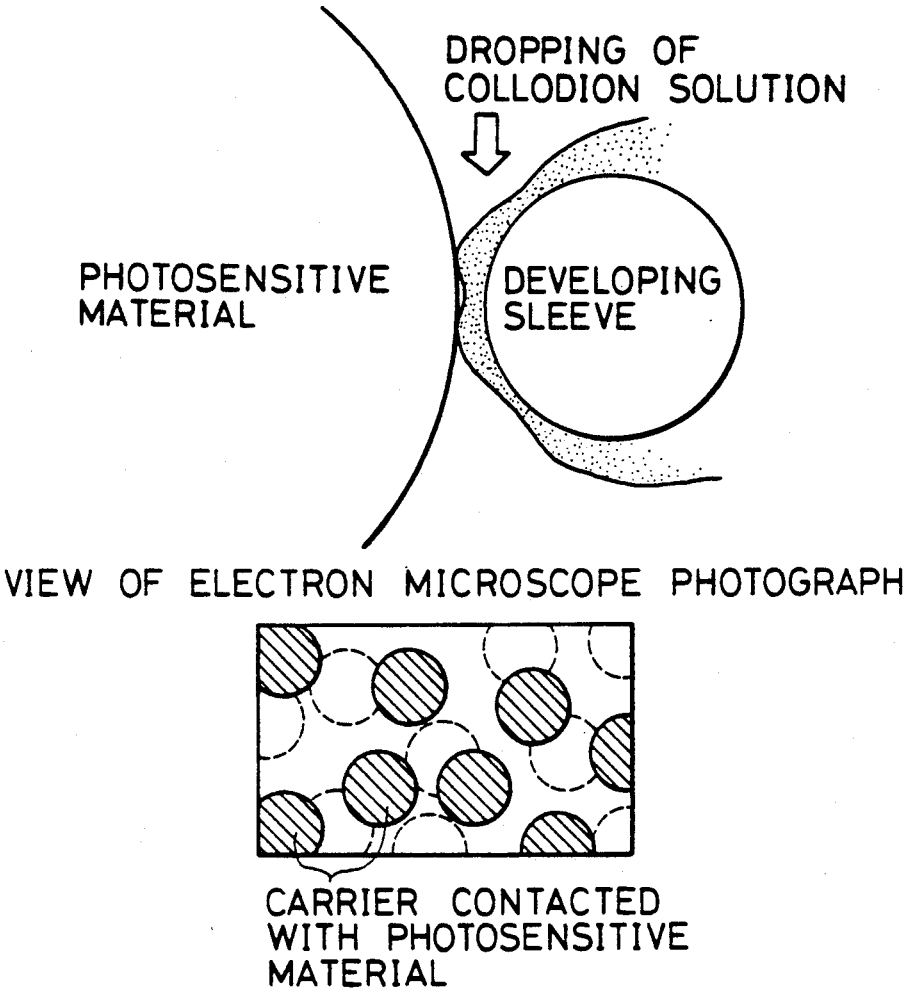
FIG. 11 is a diagram showing a scanning type electron microscope photograph of a collodion-fixed magnetic brush, to be used for measuring the number of contact points per unit area.

FIG. 11 of the accompanying drawings is a view of a scanning type electron microscope of a collodion-fixed magnetic brush of a two-component type developer suitable for use in carrying out the present invention. From this photograph, the number of the contact points per unit area can easily be measured.

The main factors influencing on the number n of the contact points of the carrier per unit area are properties of the developer, especially the magnetic carrier, and the distance ($d_{D\text{-}S}$) between the developing sleeve and the photosensitive material drum is another factor. In general, as the distance $d_{D\text{-}S}$ becomes large, n becomes small, and as the distance $d_{D\text{-}S}$ becomes small, n becomes large. If $d_{D\text{-}S}$ is constant, n depends on properties of the developer, especially properties of the magnetic carrier, particularly the saturation magnetization. As the saturation magnetization increases, n increases, and in contrast, as the saturation magnetization decreases, n decreases. Accordingly, by appropriately selecting the kind of the developer, especially the saturation magnetization of the magnetic carrier, the contact frequency (k) of the carrier can be set at a desired value. If the saturation magnetization of the magnetic carrier is adjusted to 40 to 60 emu/g, front end chipping and rear end chipping can be prevented more completely.

Figure 12:
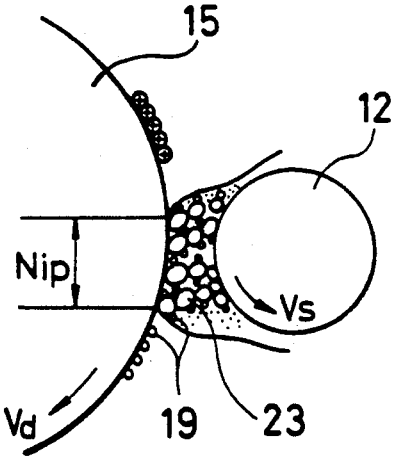
FIG. 12 is a view diagrammatically illustrating the developing zone.

The developing length in the formula (2) has the following meaning. Referring to FIG. 12 illustrating the developing zone diagrammatically, a drum 15 is moved at a peripheral speed $V_D$ and a developing sleeve 12 is moved at a peripheral speed $V_S$ so that they are moved in the same direction at the position of the nip width Nip. A magnetic brush of a magnetic carrier 23 is formed on the developing sleeve 12. A toner 19 charged, for example, negatively is present on the magnetic carrier 23, and the carrier has a positive counter charge. The toner 19 is attracted to an electrostatic latent image (positively charged) on the drum 1 to effect the development, and the counter charge on the carrier 23 escapes onto the developing sleeve 12 through the magnetic brush.

The time t of the passage of one point of the latent image through the nip position is expressed by the following formula:

$$t = \frac{Nip}{V_D}$$

The length L of the toner passing through one point of the latent image is expressed by the product of the passage time t and the speed difference between them, that is, the following formula:

$$L = \frac{Nip}{D_V}(V_S - V_D) \quad (3)$$

This developing length has the dimension of the length and is a value proportional to the quantity of the developing toner. Therefore, it is understood that the contact frequency (k) of the carrier can be set by appropriately selecting the nip width (Nip), the peripheral speed ($V_D$) of the drum and the peripheral speed ($V_S$) of the sleeve.

In this embodiment of the present invention, if the saturation magnetization is small, the number of contact points of the carrier per unit area of the photosensitive material is reduced and the contact frequency (k) tends to decrease. If the saturation magnetization is large, a reverse tendency is observed. Accordingly, the magnetic carrier has preferably a saturation magnetization of 40 to 60 emu/g, especially 45 to 56 emu/g, as well as the above-mentioned characteristics.

A ferrite carrier, especially a spherical ferrite carrier, satisfying the foregoing requirements, is preferably used as the magnetic carrier, and it is preferred that the particle size of the ferrite be 20 to 140 μm, especially 50 to 100 μm.

In the developer, it is preferred that the above-mentioned number of contact points of the carrier per unit area of the photosensitive material be 100 to 300 per $mm^2$, especially 100 to 200 per $mm^2$.

The developing conditions are the same as described above. The developing length L represented by the above-mentioned formula (3) has a relation not only to the contact frequency (k) but also to the image density. It is preferred that the nip width (Nip), the peripheral speed ($V_S$) of the developing sleeve and the peripheral speed ($V_D$) of the drum be set so that the developing length L is 4 to 35 mm, especially 4 to 20 mm.

It is preferred that the developing nip width (Nip) be 1 to 15 mm, especially 2 to 8 mm. As pointed out hereinbefore, the distance $d_{D\text{-}S}$ between the developing sleeve and the photosensitive layer has important influences on n, and it is preferred that the distance $d_{D\text{-}S}$ be 0.5 to 3.0 mm, especially 0.7 to 1.7 mm.

All of photosensitive materials customarily used in the electrophotographic process, for example, a selenium photosensitive material, an amorphous silicon photosensitive material, an OPC photosensitive material, a Cds photosensitive material, a ZnO photosensitive material, a TiO photosensitive material and a composite photosensitive material (Se/OPC laminate), can be used as the photosensitive material.

As another developing condition, there can be mentioned a bias voltage applied between the developing sleeve and the electroconductive substrate of the photosensitive material. Preferably, this bias voltage is adjusted so that the average intensity of the electric field is 100 to 1000 V/mm, especially 125 to 500 V/mm.

According to this embodiment of the present invention, by setting the contact frequency of the carrier, defined as the product of the number of contact points of the carrier per unit area of the photosensitive material, measured by fixing the magnetic brush practically contacted with the surface of the photosensitive material with collodion and observing the collodion-fixed magnetic brush by an electron microscope, and the developing length within a certain range, in reproducing multiple fine lines, the line width is kept uniform in the respective lines and front end chipping or rear end chipping can be prevented, and a high-density and high-quality image can be formed. Thus, a copying process excellent in the reproducibility of Chinese characters can be provided.

In accordance with still another embodiment of the present invention, the developing conditions are set so that the flux density H of the magnetic poles located in the developing zone, the saturation magnetization m of the magnetic carrier and the rotation number f of the developing sleeve satisfy the requirement represented by the following formula (4):

$$15{,}000 \geqq \frac{m \cdot H}{f} \geqq 7{,}000 \quad (4)$$

wherein f represents the rotation number (per second) of the developing sleeve, m represents the saturation magnetization (emu/g) of the magnetic carrier, and H represents the flux density (gauss) of magnetic poles in the developing sleeve.

In accordance with still another embodiment of the present invention, the developing conditions are set so that the requirement represented by the above formula (4) is satisfied and the contact frequency (k) of the carrier, defined by the formula (2), is 100 to 700.

These embodiments are based on the finding that if the characteristic value (m·H/f) defined by the above formula (4) is maintained in the range of from 7000 to 15000, especially from 9000 to 13000, a high image density can be attained and in reproducing massed fine lines, the line width can be kept uniform in the respective lines and front end chipping or rear end chipping can be prevented, with the result that a high-quality reproduced image can be obtained.

Figure 13:
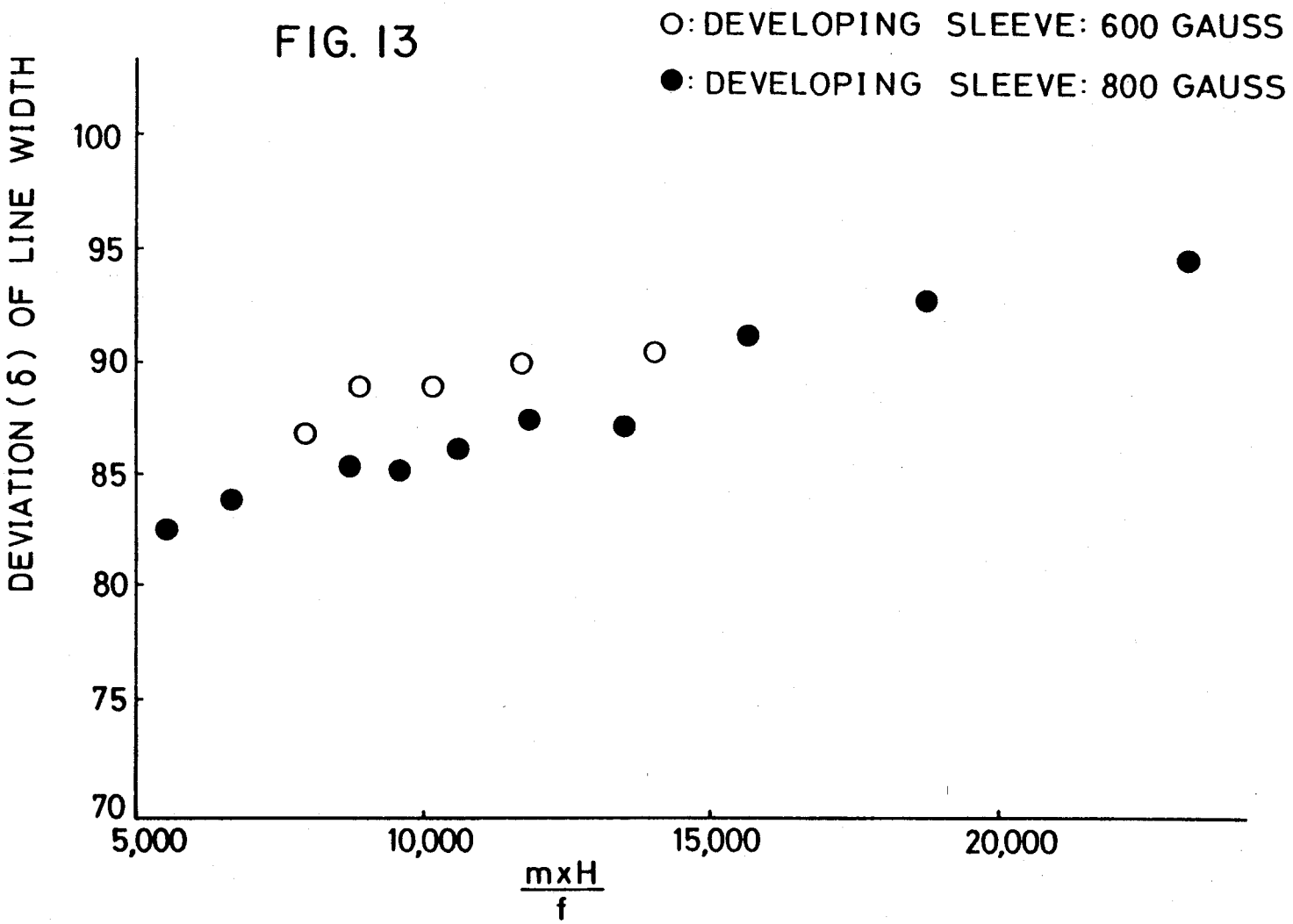
FIG. 13 is a diagram illustrating the relation between the value of (m·H)/f and the deviation ($\delta$) of the line width.
Figure 14:
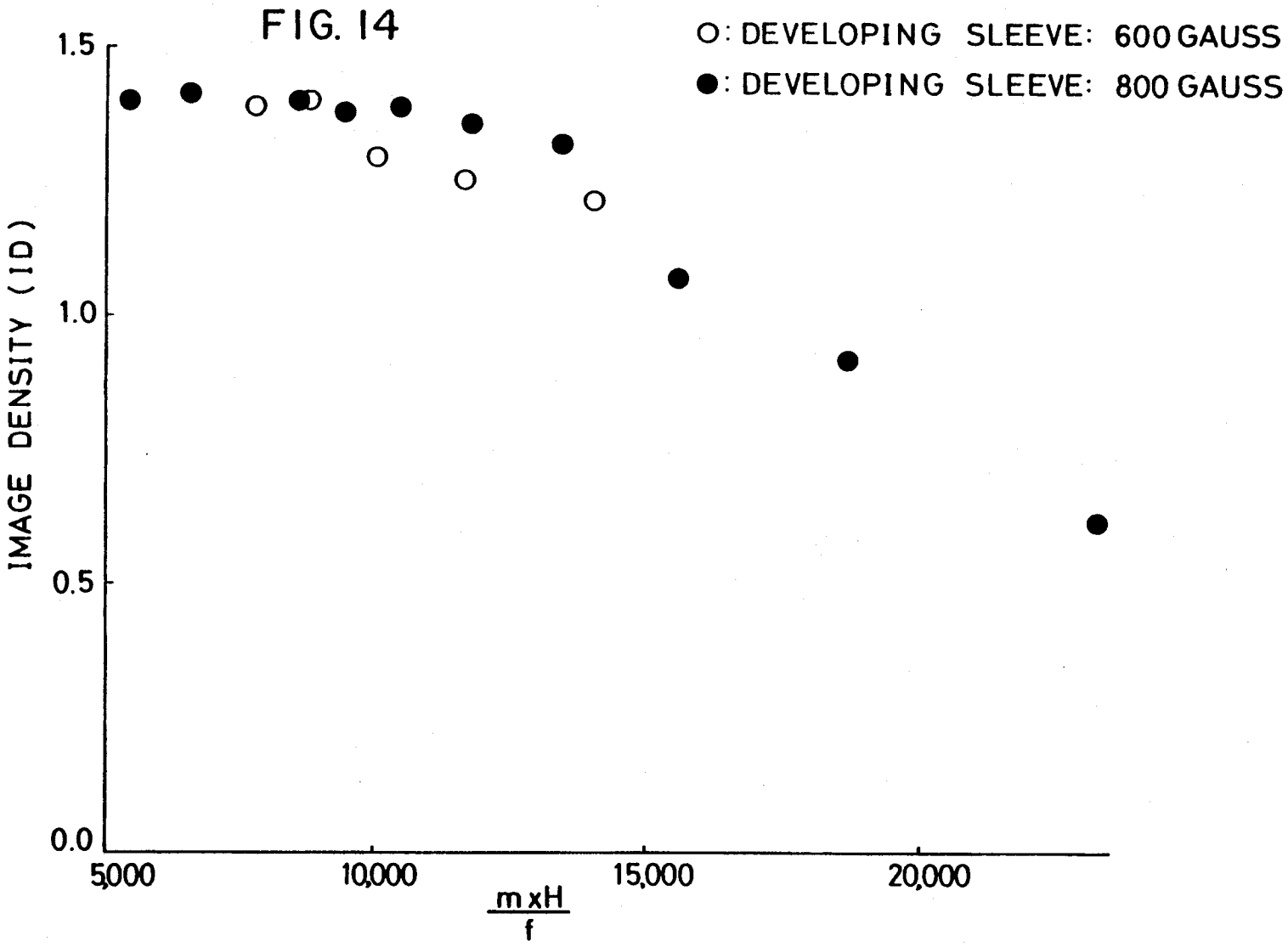
FIG. 14 is a diagram illustrating the relation between the value of (m·H)/f and the image density.

FIGS. 13 and 14 illustrate the relation between the deviation (δ) of the line width and the value of m·H/f and the relation between the image density (ID) and the value of m·H/f, respectively, observed when the value of m·H/f is changed. From the results shown in FIGS. 13 and 14, it is seen that if the value of m·H/f is maintained within the range specified in the present invention, the deviation of the line width can be maintained at a level very close to 100% while maintaining the image density at such a high level as 1.3 or more. If the value of m·H/f exceeds the above range, the reproducibility of line images is degraded and rear end chipping (front end thickening) is caused, and the image density is generally reduced. If the value of m·H/f is below the above range, front end chipping (rear end thickening) is caused and the image density is reduced, and tailing of the carrier is caused.

In the characteristic value represented by the formula of m·H/f, the numerator m·H is a value having a relation to the centrifugal force acting on the carrier, and the denominator f is a value having a relation to the centrifugal force acting on the carrier. Accordingly, the ratio between them is a dimensionless number having a relation to the balance between the centripetal force and the centrifugal force. In the range specified in the present invention, the centifugal force on the carrier is relatively small. Accordingly, the carrier is contacted very intimately with the latent image and the influence of the mechanical scraping on the toner image is small, and hence, a high-density image can be obtained. Moreover, since the freedom degree of the carrier is large, the neutralization and diffusion of counter charges are improved, and it is considered that the reproducibility of fine lines is improved by a high electric field by the edge effect.

In the present invention, by setting the carrier contact frequency (k, points/mm), defined by the above-mentioned formula (2), at 100 to 700, especially 100 to 300, the reproducibility of fine lines can be prominently improved, and scattering of the line width can be reduced.

In the foregoing embodiments of the present invention, as the saturation magnetization of the magnetic carrier is small, the value of m·H/f becomes small and the number of contact points of the carrier per unit area of the photosensitive material becomes small, with the result the contact frequency (k) tends to decrease. If the saturation magnetization of the magnetic carrier is large, a reverse tendency is observed. In view of the foregoing, it is preferred that the saturation magnetization of the magnetic carrier be 40 to 65 emu/g, especially 45 to 56 emu/g.

The developer conditions can be the same as described hereinbefore, and it is generally preferred that the number of the contact points of the carrier per unit area of the photosensitive material be 100 to 300 per $mm^2$, especially 100 to 200 per $mm^2$, as described hereinbefore.

Also the developing conditions can be the same as described hereinbefore. Preferably, the flux density of the magnetic poles in the developing sleeve is relatively small, so far as tailing of the carrier is not caused. In general, it is preferred that the flux density of the magnetic poles be 400 to 1500 gauss, especially 550 to 900 gauss. Furthermore, it is preferred that the rotation number of the developing sleeve be relatively large, that is, 1.50 to 5.00 rotations per second, though the preferred rotation number differs to some extent according to the diameter of the developing sleeve.

According to these embodiments, by setting the value of m·H/f, that is, the balance between the centripetal force and centrifugal force acting on the magnetic carrier, within a certain range and preferably, setting the contact frequency of the carrier, defined by the product of the number of contact points of the carrier per unit area of the photosensitive material, measured by fixing the magnetic brush practically contacted with the surface of the photosensitive material with collodion and observing the collodion-fixed magnetic brush by an electron microscope and the developing length within a certain range, in reproducing multiple fine lines, the line width can be kept uniform in the respective lines while maintaining the image density at a high level, and front end chipping or rear end chipping can be prevented and a high-density and high-quality image can be formed. Thus, a copying process excellent in the reproducibility of Chinese characters can be provided.

The present invention will now be described in detail with reference to the following examples that by no means limit the scope of the invention.

EXAMPLE 1

In a remodelled machine of a commercially available electrophotographic copying machine (Model DC-2555 supplied by Mita Industrial Co.), three developers having properties shown in Table 1 were used, and the relaxation time was measured according to the method shown in FIG. 1 while changing developing conditions (the distance $d_{D-S}$ between the photosensitive material drum and the developing sleeve, the peripheral speed ratio $V_S/V_D$ between the developing sleeve and the photosensitive material drum and the nip width in the developing zone). Simultaneously, the obtained image quality (image density (ID) and the deviation (δ)) was determined. Incidentally, the surface potential of the main charged photosensitive material was maintained at 800 V. The obtained results are shown in Table 2.

From the results shown in Table 2, it is seen that if the relaxation time (τ) is 8 to 40 msec, a satisfactory image having a high image density and a reduced deviation of the line width can be obtained, and that if the time difference (ΔT) is 0 to 130 msec as in Runs 4 and 6, an especially excellent image can be obtained.

TABLE 1

| Physical Properties | A | B | C |
|---|---|---|---|
| Toner | | | |
| volume-based median diameter (μm) | 11.0 | 10.5 | 11.0 |
| resistivity (Ω · cm) | $2.2 \times 10^9$ | $6.3 \times 10^8$ | $2.5 \times 10^8$ |
| dielectric constant | 2.7 | 3.09 | 3.83 |
| charge quantity (μc/g) | 14 | 21 | 15 |
| Carrier | | | |
| volume-based median diameter (μm) | 75 | 95 | 130 |
| resistivity (Ω · cm) | $4.6 \times 10^9$ | $2.2 \times 10^{10}$ | $1.5 \times 10^{11}$ |
| dielectric constant | 8.10 | 6.45 | 6.07 |
| saturation magnitization (emu/g) | 64 | 55 | 40 |

TABLE 2

| | | Developing Conditions | | | | | | | Image Characteristics | |
|---|---|---|---|---|---|---|---|---|---|---|
| Run No. | Developer | distance dD-S (mm) | $V_S/V_D$ | drum peripheral speed $V_D$ (mm/sec) | bias voltage (V) | nip width (mm) in developing zone | relaxation time (τ) (msec) | time difference ΔT | image density (I.D) | deriation (δ) |
| 1 | A | 1.2 | 3.35 | 153.2 | 250 | 9.0 | 5.8 | 190 | 1.411 | 75.0 |
| 2 | A | 1.0 | 1.85 | 153.2 | 250 | 14.0 | 11.0 | 158 | 1.344 | 84.0 |
| 3 | B | 1.0 | 3.05 | 153.2 | 250 | 5.5 | 10.5 | 98 | 1.408 | 86.1 |
| 4 | C | 1.0 | 3.35 | 153.2 | 250 | 5.0 | 13.1 | 96 | 1.520 | 92.4 |
| 5 | B | 1.2 | 2.15 | 153.2 | 250 | 9.0 | 18.2 | 108 | 1.320 | 90.3 |

TABLE 2-continued

| Run No. | Developer | Developing Conditions: distance dD-S (mm) | $V_S/V_D$ | drum peripheral speed $V_D$ (mm/sec) | bias voltage (V) | nip width (mm) in developing zone | relaxation time ($\tau$) (msec) | time difference ΔT | Image Characteristics: image density (I.D) | deviation (δ) |
|---|---|---|---|---|---|---|---|---|---|---|
| 6 | C | 1.0 | 1.85 | 153.2 | 250 | 7.0 | 22.8 | 62 | 1.432 | 92.9 |
| 7 | C | 1.0 | 1.55 | 153.2 | 250 | 7.0 | 27.7 | 43 | 1.387 | 84.1 |
| 8 | C | 1.4 | 1.55 | 153.2 | 250 | 4.0 | 41.8 | −1 | 0.434 | 122.9 |
| 9 | B | 1.2 | 3.35 | 153.2 | 250 | 9.0 | 21.5 | 174 | 1.325 | 81.7 |
| 10 | A | 1.4 | 1.25 | 153.2 | 250 | 4.5 | 38.0 | −1 | 1.307 | 83.3 |

EXAMPLE 2

In Run 9 of Example 1, the peripheral speed of the developing sleeve was changed and the peripheral speed ratio $V_S/V_D$ between the developing sleeve and the photosensitive material drum was changed to 2.15 from 3.35, and thus, the developing conditions were changed so that the relaxation time ($\tau$) was 18.2 msec and the time difference ΔT was 108. The deviation (δ) was improved to 90.3 while maintaining the image density (ID) at a high level (1.325).

EXAMPLE 3

In Run 9 of Example 1, the peripheral speed of the developing sleeve and the distance between the developing sleeve and the photosensitive material drum were changed and the developing conditions were set so that the distance between the developing sleeve and the photosensitive material drum was 1.0 mm, the peripheral speed ratio between the developing sleeve and the photomaterial drum was 3.0 and the nip width in the developing zone was 5.3 mm, whereby the relaxation time ($\tau$) was adjusted to 10.0 msec and the time difference ΔT was adjusted to 96 msec. The image density (ID) and the deviation (δ) were improved to 1.412 and 87.1, respectively.

EXAMPLE 4

In Run 2 of Example 1, by changing the peripheral speed of the developing sleeve and the distance between the developing sleeve and the photosensitive material drum, the developing conditions were set so that the distance between the developing sleeve and the photosensitive material drum was 1.2 mm, the peripheral speed ratio between the developing sleeve and the photosensitive material drum was 2.15 and the developing nip width 5.3 mm, whereby the relaxation time ($\tau$) was adjusted to 16 msec and the time difference ΔT was adjusted to 50 msec. The image density (ID) and the deviation (δ) were improved to 1.383 and 91.3, respectively.

From the results obtained in Examples 2, 3 and 4, it is seen that if the time difference ΔT is adjusted within the range of from 0 to 130 while setting the relaxation time ($\tau$) with the preferred range, the image quality is much highly improved.

EXAMPLE 5

In a remodelled machine of a commercially available electrophotographic copying machine (Model DC-2555 supplied by Mita Industrial Co.), three developers having properties shown in Table 1 were used, and the frequency (k) was measured while changing developing conditions (the distance $d_{D\text{-}S}$ between the photosensitive material drum and the developing sleeve, the peripheral speed ratio $V_S/V_D$ between the developing sleeve and the photosensitive material drum and the nip width in the developing zone). Simultaneously, the obtained image quality (image density (ID) and the deviation (δ) of massed fine lines) was determined. Incidentally, the brush-cutting gap was 1.0 mm and the surface potential of the main charged photosensitive material was maintained at 800 V. The obtained results are shown in Table 3.

From the results shown in Table 2, it is seen that if the frequency (k) is in the range of from 100 to 700, good results are obtained with respect to each of the image density and the deviation of fine lines. In Runs 11 to 13, images having an especially high image density were obtained, and in Runs 11 and 13, the values of m H/f were 13061 and 9429, respectively. In Runs 16 through 21, even if the image density was satisfactory, the deviation of the fine lines was bad, or even if the deviation of the fine lines was satisfactory, the image density was low, because the frequency was lower than 100 or higher 700 and the value of m·H/f was smaller than 7000 or larger than 15000.

TABLE 3

| Run No. | Developer | Developing Conditions: distance dD-S (mm) | $V_S/V_D$ | nip width (mm) in developing zone | flux density (H) (emurg) of developing sleeve | rotation number (f) (Hz) of developing sleeve | number (n) of contact points of carrier | m · H / f | k | Image Characteristics: image density (I.D) | deviation (δ) |
|---|---|---|---|---|---|---|---|---|---|---|---|
| 11 | C | 1.0 | 2.45 | 7.0 | 800 | 3.5 | 9 | 13061 | 145 | 1.507 | 92.6 |
| 12 | B | 1.0 | 3.35 | 10.0 | 800 | 4.78 | 20 | 9205 | 650 | 1.405 | 88.2 |
| 13 | B | 1.2 | 2.45 | 9.0 | 800 | 3.50 | 19 | 9429 | 400 | 1.442 | 91.9 |
| 14 | A | 1.2 | 2.45 | 14.0 | 800 | 3.50 | 9 | 14629 | 300 | 1.390 | 85.3 |
| 15 | A | 1.0 | 2.15 | 14.0 | 800 | 3.08 | 10 | 16623 | 291 | 1.389 | 90.2 |
| 16 | A | 1.0 | 2.15 | 14.0 | 800 | 3.08 | 42 | 16623 | 1132 | 1.380 | 73.2 |
| 17 | C | 1.0 | 1.25 | 7.0 | 800 | 1.78 | 8 | 17978 | 62 | 0.869 | 85.0 |
| 18 | C | 1.2 | 3.35 | 7.0 | 800 | 4.78 | 4 | 6690 | 90 | 1.217 | 94.0 |
| 19 | B | 1.0 | 1.85 | 10.5 | 800 | 2.65 | 47 | 16604 | 866 | 1.076 | 87.6 |
| 20 | A | 1.4 | 2.15 | 6.5 | 800 | 3.08 | 5 | 16650 | 65 | 0.613 | 94.6 |

TABLE 3-continued

| Run No. | Developer | Developing Conditions: distance dD-S (mm) | $V_S/V_D$ | nip width (mm) in developing zone | flux density (H) (emurg) of developing sleeve | rotation number (f) (Hz) of developing sleeve | number (n) of contact points of carrier | m · H / f | k | Image Characteristics: image density (I.D) | deviation (δ) |
|---|---|---|---|---|---|---|---|---|---|---|---|
| 21 | B | 1.4 | 1.55 | 5.5 | 800 | 2.22 | 10 | 19820 | 75 | 0.861 | 102.1 |

We claim:

1. A developing process excellent in the reproducibility of images, which comprises forming a magnetic brush of a two-component type developer comprising a magnetic carrier and a toner on a developing sleeve and bringing the magnetic brush into sliding contact with a photosensitive material having a charged image thereon to form a toner image, wherein the relaxation time ($\tau$) of a circuit constructed by the developing sleeve, the developer and the surface of the photosensitive material is set at 8 to 40 milliseconds wherein said time is measured at a frequency of 50 Hz under dynamic conditions while changing the surface of the photosensitive material to an electroconductive surface of the same size.

2. A developing process excellent in the reproducibility of images, which comprises forming a magnetic brush of a two-component type developer comprising a magnetic carrier and a toner on a developing sleeve and bringing the magnetic brush into sliding contact with a photosensitive material having a charged image thereon to form a toner image, wherein the developing sleeve and the surface of the photosensitive material are driven in the same direction at the nip position, and the developing conditions are set so that the time difference ($\Delta T$) defined by the following formula is 0 to 130 msec:

$$\Delta T = \frac{Nip \cdot Vs}{Vd^2} - \tau$$

wherein Nip represent the nip width (mm) of the developer on the surface of the photosensitive material, Vs represents the moving speed (mm/sec) of the developing sleeve, Vd represents the moving speed (mm/sec) of the surface of the photosensitive material, and $\tau$ represents the relaxation time (msec) which is measured at a frequency of 50 Hz under dynamic conditions while changing the surface of the photosensitive material to an electroconductive surface of the same size with respect to a circuit constructed by the developing sleeve, the developer and the surface of the photosensitive material.

3. A developing process excellent in the reproducibility of images, which comprises forming a magnetic brush of a two-component type developer comprising a magnetic carrier and a toner on a developing sleeve and bringing the magnetic brush into sliding contact with a photosensitive material having a charged image thereon, wherein the sliding contact between the magnetic brush and the photosensitive material is carried out so that the frequency (k) defined by the following formula is 100 to 700:

$$k = L \cdot n$$

wherein n represents the number of carrier contact points (points per mm$^2$) per unit area of the surface of the photosensitive material, determined from a scanning electron microscope photograph with respect to the collodion-fixed magnetic brush, and L represents the developing length defined by the following formula:

$$L = \frac{Nip}{Vd}(Vs - Vd)$$

in which Nip represents the nip width (mm) of the developer on the surface of the photosensitive material, Vs represents the moving speed (mm/sec) of the developing sleeve and Vd represents the moving speed (mm/sec) of the surface of the photosensitive material.

4. A developing process excellent in the reproducibility of images, which comprises forming a magnetic brush of a two-component type developer comprising a magnetic carrier and a toner on a developing sleeve and bringing the magnetic brush into sliding contact with a photosensitive material having a charged image thereon, wherein the developing conditions are set so that the requirement defined by the following formula is satisfied:

$$15{,}000 \geqq \frac{m \cdot H}{f} \geqq 7{,}000$$

wherein f represents the rotation number (per second) of the developing sleeve, m represents the saturation magnetization (emu/g) of the magnetic carrier, and H represents the flux density (gauss) of magnetic poles in the developing sleeve.

5. A developing process excellent in the reproducibility of images, which comprises forming a magnetic brush of a two-component type developer comprising a magnetic carrier and a toner on a developing sleeve and bringing the magnetic brush into sliding contact with a photosensitive material having a charged image thereon, wherein the developing conditions are set so that the requirement defined by the following formula is satisfied:

$$15{,}000 \geqq \frac{m \cdot H}{f} \geqq 7{,}000$$

wherein f represents the rotation number (per second) of the developing sleeve, m represents the saturation magnetization (emu/g) of the magnetic carrier, and H represents the flux density (gauss) of magnetic poles in the developing sleeve, and the frequency (k) defined by the following formula is 100 to 700:

$$k = L \cdot n$$

wherein n represents the number of carrier contact points (points per mm$^2$) per unti area of the surface of the photosensitive material, determined from a scanning electron microscope photograph with respect to the collodion-fixed magnetic brush, and L represents the developing length defined by the following formula:

$$L = \frac{Vip}{Vd}(Vs - Vd)$$

in which Nip represents the nip width (mm) of the developer on the surface of the photosensitive material, Vs represents the moving speed (mm/sec) of the developing sleeve and Vd represents the moving speed (mm/sec) of the surface of the photosensitive material.

6. A developing process excellent in the reproducibility of images, which comprises forming a magnetic brush of a two-component type developer comprising a magnetic carrier and a toner on a developing sleeve and bringing the magnetic brush into sliding contact with a photosensitive material having a charged image thereon to form a toner image, wherein the relaxation time ($\tau$) of a circuit constructed by the developing sleeve, the developer and the surface of the photo-sensitive material is set at 8 to 40 milliseconds by changing a capacitor component (A) and a resistance component (R) of the circuit, and wherein the relaxation time is measured at a frequency of 50 Hz under dynamic conditions.

* * * * *